US007434754B2

(12) United States Patent
Sharp

(10) Patent No.: US 7,434,754 B2
(45) Date of Patent: Oct. 14, 2008

(54) DYNAMIC SCREEN PROCESS FOR HOGGING APPARATUS

(75) Inventor: Rodney Warwick Sharp, Hamilton (NZ)

(73) Assignee: Progressive IP Limited, Hamilton (NZ)

( * ) Notice: Subject to any disclaimer, the term of this patent is extended or adjusted under 35 U.S.C. 154(b) by 285 days.

(21) Appl. No.: 11/091,751

(22) Filed: Mar. 29, 2005

(65) Prior Publication Data

US 2006/0219828 A1 Oct. 5, 2006

(30) Foreign Application Priority Data

Mar. 29, 2004 (NZ) ..... 532005

(51) Int. Cl.
*B02C 13/00* (2006.01)

(52) U.S. Cl. ..... 241/69; 241/101.8

(58) Field of Classification Search ..... 241/69, 241/73, 74, 79, 101.8
See application file for complete search history.

(56) References Cited

U.S. PATENT DOCUMENTS 5,927,624 A * 7/1999 Hughes ..... 241/69

* cited by examiner

*Primary Examiner*—Derris H Banks
*Assistant Examiner*—Debra M Wolfe
(74) *Attorney, Agent, or Firm*—Young & Thompson

(57) ABSTRACT

The present invention relates to the use of an agitator (10) positioned near the screen (4) of a hogger to increase turbulence in that region. The induced turbulence from the driven blades (15) of the agitator (10) reorients material contained within the hogger (1), thereby representing the material to the screen (4) and grinding disc (5) with potential improvements in both screening and comminuting efficiency.

16 Claims, 3 Drawing Sheets

DYNAMIC SCREEN PROCESS FOR HOGGING APPARATUS

BACKGROUND OF THE INVENTION

1. Field of Invention

The present invention is directed to modifications to log hogging apparatus. This is typically apparatus which breaks down logs and off-cuts of wood into smaller pieces, and which are commonly then used as a fuel. More specifically the present invention preferably finds use in hogging assemblies which use a screening process for separating comminuted product of sufficiently reduced size.

2. Description of the Related Art

'Hog fuel' is a combustible solid fuel often used in boilers and which is primarily made up of wood residue from sawmills, logging operations, and various wood off-cuts. Hog fuel typically varies from chipped wood as it commonly may comprise timber of a variety of sizes rather than substantially uniform chips of wood. Typically hog fuel may comprise pieces of wood typically 50 mm×50 mm×120 mm down to sawdust. It is commonly made from product which would otherwise be dumped, and may contain a significant amount of foreign materials such as dirt, and stones, depending on the source of the material and how well the material is screened prior to processing.

The machines used to prepare hog fuel are commonly known as 'hoggers' and may also be called reducers, depending on their construction. Quite a number of different sizes exist, and in most case rely on rotating discs or drums with chipping or cutting teeth or features. In many instances these are used in conjunction with a grate which screens reduced material suitable for hog fuel, from product which has not yet been sufficiently reduced. Most designs have a number of flaws or problems associated with them, which at least partially counts for the presence of a number of substantially different standard designs available on the market.

It is also common for many of these devices to be used for reducing a variety of materials. While the ideal starting material for hog fuel is woody material, many hoggers are starting to find application as a means for shredding green plant material. While woody material—particularly if at least partially dry—possesses some rigidity and weight which is desirable in any screening process (separating reduced from unreduced material), green and leafy material tends to block screens and exacerbates many of the problems to be described below.

Many hoggers have also found application reducing quite different types of materials, including removed asphalt roading, tyres, soft rock, soft metals and mild scrap steels, etc. Tyres in particular can represent a problem similar to green plant matter as the steel cords and belts can block screens rather than passing through. This again exacerbates types of problems such as described below.

In an ideal situation, reduced material will be removed as soon as possible from the chamber or vessel in which reducing is taking place. If it is not effectively removed, then already processed material will be reintroduced to the reducing blades or equipment, rather than fresh material. Additionally, failure to effectively remove reduced material also affects the throughput, as well as potentially binding the machine and placing increasing load on components and motors.

The most noticeable outcome of ineffective removal of reduced material is energy consumption. This affects not only the energy efficiency of the process (an important overall consideration) but also the size of the motors required to drive the various components. Poor energy efficiency is a common problem affecting most designs.

Even in ideal circumstances, the process of reducing timber product into smaller reduced pieces suitable for hog fuel consumes a significant amount of energy. Careful consideration needs to be given to the economy of the process to ensure that the energy expended does not exceed the resulting energy which can be obtained from what is essentially a low-grade fuel. In such a case it becomes uneconomic to produce the hog fuel. The implications of this can be more clearly seen if one considers that hog fuel is not only a useful and renewable energy source, but also that it is a waste recycling process. If the fuel is not made, not only is the hog fuel user affected, but the producer of the raw material is then faced with a waste disposal problem. Hence, there are a number of potentially realisable benefits from improving the overall efficiency of hogging processes producing hog fuel.

These benefits can also extend to other applications of hoggers, such as the reducing of other materials. In most cases the reduced material is able to be recycled for other applications, and thus the hogger acts as a useful recycling tool. However, recycling—unless there is government legislation requiring it—is typically a cost conscious exercise. Improving efficiency, to improve the economy of the process, can have a significant bearing on whether this type of recycling technique is used as opposed to landfill or dumping etc.

In a number of instances the specific design of the hogging apparatus has a bearing on energy efficiency, and there are a number of different types of design in use. The primary type of hogger design to be considered for the present invention is a tub-type hogger where a substantially cylindrical tub with open top contains a rotating horizontal disc (rotating about a vertical axis) near its bottom. The bottom of the tub typically comprises a grate which allows suitably reduced pieces of wooden material to fall therethrough. The rotating disc bears a plurality of teeth or projections which interact with bulk material which is loaded into the tub. However, it should be envisaged that the process of the present invention can be adapted and applied to other hogger designs.

There are a number of problems associated with the tub type of apparatus. For instance, there is typically a high wear and high energy usage associated with this particular design. As the disc is usually almost always totally immersed in various material, the blades are always being subjected to wear. Additionally a large amount of energy is also required to continue driving the disc in such conditions.

Associated with this type of apparatus are also problems with screening. Reduced material is produced by the interaction of the disc with the bulk material. Accordingly reduced material is in immediate proximity to the rotating disc, rather than the grate. Between this reduced material and the grate may be bulk material of too large a size to actually pass through the grate. Hence, bulk material within the tub may act as a barrier to the efficient removal of screen material as it is produced. Green plant matter or stringy material (such as the steel cords for tyres) significantly increase this problem, laying across screen apertures and effectively clogging them. As a consequence of screen clogging, already reduced material may be unnecessarily further reduced in size just because it is in the very vicinity of the rotating disc.

It has also being found that the degree of loading in this type of hogger affects its performance and efficiency. When the apparatus is under filled, it is found that a large amount of energy is wasted by the discs spinning with little interaction with material. In this condition the process may be more efficient in terms of removing material from within the tub, though it is also possible that quite large pieces may be expelled from the grate—e.g. relatively long lengths which may be of sufficiently small cross sections to pass through the grate in a substantially vertical orientation.

However, different types of problems occur when overfilling the tub with bulk material. When the optimum fill level is exceeded, then the disc may then act more as a mixer blade and either end up stirring the material, or arrive at a situation where the material close to the rotating disc can be over processed while material further away may be under processed. Such situations also give rise to earlier mentioned case where sufficiently reduced material is not quickly screened from the tub but remains in the system. As can be appreciated, such overfilling also increases the wear on the teeth as they are now in even more constant contact with bulk material.

As can be seen, poor screening efficiency can have a significant result on the efficiency of tub type hoggers, particularly if they lead to an over-full state. The result of actual or induced overfilling is typically a significant energy draw and wastage, as well as high component wear. It is also noted that such problems can also arise in other types of hogger design which rely on screening processes, though not normally to the same extent as they may occur in tub-type hoggers. Nevertheless there is still a need to look at improving screening processes in various hogger designs where problems of efficiency and component wear still arise.

It is therefore an object of the present invention to provide means to improve the screening efficiency of reduced material in hoggers.

It is also an object of the present invention to address the aforementioned problems.

At the very least it is an object of the present invention to provide the public with a useful choice.

Aspects of the present invention will be described by way of example only and with reference to the ensuing description.

BRIEF SUMMARY OF THE INVENTION

According to one aspect of the present invention there is provided apparatus for comminuting raw material, said apparatus comprising at least:

a housing;

a reducing assembly, at least one screen for passing comminuted material up to a particular size, at least one agitator in proximity to said screen which agitates comminuted material in its vicinity.

According to another aspect of the present invention there is provided apparatus, substantially as described above, in which the reducing assembly is a rotating toothed assembly.

According to another aspect of the present invention there is provided apparatus, substantially as described above, in which the rotating toothed assembly is a disc or cylinder.

According to another aspect of the present invention there is provided apparatus, substantially as described above, in which the said housing is substantially a cylindrical tub or barrel.

According to another aspect of the present invention there is provided apparatus, substantially as described above, in which the cylindrical axis of said housing is inclined to the horizontal.

According to another aspect of the present invention there is provided apparatus, substantially as described above, in which the cylindrical axis of said housing is substantially vertical.

According to another aspect of the present invention there is provided apparatus, substantially as described above, in which the top of the tub is substantially open.

According to another aspect of the present invention there is provided apparatus, substantially as described above, in which a said screen is present in the bottom floor portion of said housing.

According to another aspect of the present invention there is provided apparatus, substantially as described above, in which a said screen is present in an end of said housing.

According to another aspect of the present invention there is provided apparatus, substantially as described above, in which a said screen is present in the cylindrical side-wall of said housing.

According to another aspect of the present invention there is provided apparatus, substantially as described above, in which the rotational axis of the rotating toothed assembly is substantially parallel to the cylindrical axis of the tub.

According to another aspect of the present invention there is provided apparatus, substantially as described above, in which the housing rotates during operation of the apparatus.

According to another aspect of the present invention there is provided apparatus, substantially as described above, in which a said agitator includes at least one rotating blade.

According to another aspect of the present invention there is provided apparatus, substantially as described above, in which said blade extends or depends from a rotating support.

According to another aspect of the present invention there is provided apparatus, substantially as described above, in which said support is a shaft.

According to another aspect of the present invention there is provided apparatus, substantially as described above, in which the general plane of a said blade is substantially parallel to or substantially includes the rotational axis of a said support.

According to another aspect of the present invention there is provided apparatus, substantially as described above, in which the general plane of a said blade is substantially perpendicular to the rotational axis of a said support.

According to another aspect of the present invention there is provided apparatus, substantially as described above, in which the bladed end of the agitator resembles a propeller or turbine.

According to another aspect of the present invention there is provided apparatus, substantially as described above, in which the general plane of a said blade is substantially parallel to or substantially includes the rotational axis of a said support.

According to another aspect of the present invention there is provided apparatus, substantially as described above, in which a said blade of the agitator is positioned helically about said support.

According to another aspect of the present invention there is provided apparatus, substantially as described above, in which the agitator is mounted such that the rotational axis of the support is substantially parallel to the general plane of a screen with which it interacts.

According to another aspect of the present invention there is provided apparatus, substantially as described above, where said screen is positioned in a cylindrical wall of a housing.

According to another aspect of the present invention there is provided apparatus, substantially as described above, in which the rotating axis of the rotating support is substantially parallel to the cylindrical axis of the housing.

According to another aspect of the present invention there is provided apparatus, substantially as described above, in which the housing is oriented such that its cylindrical axis is substantially vertical and the agitator interacts with a screen positioned in the bottom end of the housing;

the rotational axis of the rotating support being substantially parallel to the plane of the bottom end of the housing, and additionally orientated within ±45° inclusive of the perpendicular to the rotational axis of the housing.

According to another aspect of the present invention there is provided apparatus, substantially as described above, in which the rotational axis of the rotating support is directed to trail tangentially outwardly from the general direction that the reducing assembly is rotating.

According to another aspect of the present invention there is provided apparatus, substantially as described above, in which the rotational axis of the support is either or both:

i) substantially parallel to the sidewall of the housing, or ii) substantially perpendicular to an end wall of the housing; the blade attached to the support interacting with a screen provided in an end wall of said housing.

According to another aspect of the present invention there is provided apparatus, substantially as described above, in which the housing is oriented such that its cylindrical axis is substantially vertical.

According to another aspect of the present invention there is provided apparatus, substantially as described above, in which the agitator is attached to a sidewall of said housing.

According to another aspect of the present invention there is provided apparatus, substantially as described above, in which the agitator includes at least one moving blade or feature which interacts with raw material in the vicinity of a screen, said blade or feature approaching said screen by a distance of 250% or less of the diameter of the average diameter of the size of a generally passable article by the screen.

According to another aspect of the present invention there is provided apparatus, substantially as described above, in which a blade on the agitator approaches said screen by a distance of 150% or less of the average diameter of the size of a generally passable article by the screen.

According to another aspect of the present invention there is provided apparatus, substantially as described above, wherein the average diameter of the size of a generally passable article is the average of the diameter or smallest diagonal measurements across apertures in the screen.

According to another aspect of the present invention there is provided apparatus, substantially as described above, in which a blade on the agitator approaches said screen by a distance of 150% or less of the average diameter of the size of a generally passable article by the screen.

According to another aspect of the present invention there is provided apparatus, substantially as described above, in which the agitator is powered.

According to another aspect of the present invention there is provided apparatus, substantially as described above, in which the agitator is powered by a direct drive hydraulic motor, electric motor, pneumatically powered motor, or fuelled motor.

According to another aspect of the present invention there is provided apparatus, substantially as described above, in which the agitator includes a rotating blade and wherein rotation of the blade portion of the agitator is by virtue of said motor.

According to another aspect of the present invention there is provided apparatus, substantially as described above, in which the motor is positioned remotely and drive transmitted to said blade.

According to another aspect of the present invention there is provided apparatus, substantially as described above, in which the agitator is powered by the motor driving the reducing assembly.

According to another aspect of the present invention there is provided apparatus, substantially as described above, in which the agitator includes a blade portion, and wherein the screen moves relative to said agitator, said blade portion rotating in a direction opposing the relative travel of the screen therepast.

According to another aspect of the present invention there is provided apparatus, substantially as described above, in which the linear tangential speed of a blade at its position of closest approach to the screen, during normal operation, is within the inclusive range of 25% through 400% of the linear screen velocity at that point.

According to another aspect of the present invention there is provided apparatus, substantially as described above, in which there are a plurality of agitators.

According to a further aspect of the present invention there is provided an agitator adapted for use in comminuting apparatus, substantially as described above, said agitator comprising:

a rotating shaft, a blade portion including at least one blade generally extending outwardly from said shaft, and said agitator being adapted to mount on said comminuting apparatus such that the rotating blade portion is in near proximity to a screen of the apparatus.

According to another aspect of the present invention there is provided an agitator, substantially as described above, in which the agitator is able to be mounted such that said shaft is within ±45° inclusive of the perpendicular to the direction of travel of comminuted material driven past the blade portion.

According to another aspect of the present invention there is provided an agitator, substantially as described above, in which a screen moves relative to the agitator, and in which the agitator is able to be mounted such that the shaft is within ±45° inclusive of the perpendicular to the direction of travel of the screen past the blade portion.

According to another aspect of the present invention there is provided an agitator, substantially as described above, in which the agitator includes a motor for rotationally driving the shaft.

According to a further aspect of the present invention there is provided a method for increasing the energy efficiency of comminuting apparatus comprising a reducing assembly, housing and one or more screens, said method in turn comprising the provision of at least one agitator in proximity to a screen on the apparatus, the agitator increasing the turbulence or agitation of comminuted or partially comminuted material in its vicinity.

According to a further aspect of the present invention there is provided comminuting apparatus in the form of a tub-type hogger, said apparatus comprising at least a vertically oriented tub or cylindrical shaped housing having at least one screen on at least its bottom end, and provision at its top for introducing raw material;

the apparatus including a reducing assembly in the form of a rotating toothed disc, the rotational axis of said disc being substantially vertical and parallel to the cylindrical axis of the housing;

there being included at least one agitator unit which includes a driven rotating blade which increases turbulence of raw and processed material in the vicinity of a screen.

There are a number of aspects to the present invention including a hogger which includes what shall be referred to as a 'dynamic screening process', as well as apparatus which may be retrofitted to an existing device to improve its operation.

One way of describing what the present invention seeks to achieve is to use the term 'dynamic screening process'. Investigations by the inventor have indicated that many of the problems which are readily apparent in tub-type hoggers stem from the fact that the screening process is relatively inefficient. As a consequence material which should have been screened remains in the system only to be re-comminuted instead of fresh material. In the standard tub-type hogger it is perhaps best to describe the screening process as a 'static screening process' where reduced pieces of material must find their own way to the bottom and through the screen. Typically it is the induced turbulence and agitation provided by the interaction of the rotating disc with material in the tub which ultimately allows the reduced material to find its way to the bottom and exit. However depending upon the level of filling of the tub, this is not always an efficient process. Consequently, when the tub is not maintained at the optimum fill level (a virtually impossible task) efficiency drops substantially, with associated over processing, high energy usage, and high component wear.

Many tub type hoggers do introduce a rotational component to their operation. For instance, in one type the rotating disc is mounted on a substantially stationary platform while the tub and bottom screen rotates thereabout. This has the action of introducing the disc to continually changes parts of the screen, though any turbulence imparted by the action of the disc to material in the vicinity of the bottom screen is very much limited to in the current vicinity of the rotating disc—the remainder of the screen at any point in time relies on static screening.

A variation is where the outer tub is stationary, but the disc is mounted on a rotating platform. The effect is virtually the same as in the aforesaid arrangement, and the problems remain the same. Blockage of screens can still occur as a consequence of the presence of green plant matter and stringy material, or overfilling, regardless of the relative motion of the disc to the screen. The reliance on static screening for much of the screen area reduces efficiency.

Dynamic screening according to the present invention seeks to provide agitation and turbulence in the vicinity of the screen. This agitation will typically be different to the agitation which might otherwise be induced in the standard apparatus without the present invention. Ideally this agitation should be such that material in the vicinity of the screen may be presented to the screen in different orientations than they otherwise might have, as well as mixing the materials so that different raw and reduced material in the tub or system become introduced to the screen.

It has been also previously indicated that if a tub-type hogger is not filled to the correct level, the rotating disc may also have more of a localised mixing rather than desired comminuting action. It is considered that agitation means used in the dynamic screening process of the present invention, if appropriately placed, can further enhance performance by agitating material in the vicinity of the rotating disc. As is the case for the screen, this process can then also continually re-present new material to the rotating disc, or existing material in a different orientation. This avoids situations where the disc may be continually reprocessing a particular localised volume in the tub rather than being continually presented with fresh material.

Dynamic screening according to the present invention relies on suitable agitating means. Typically this may be what can be conveniently described as an agitator, with the possibility that more than one 'agitator' may be used in a single hogger apparatus. The agitator may be located in a number of positions, often depending on the type of hogger apparatus, but in each case mounted in a position where it can induce turbulence and agitation in the vicinity of a screen. In tub type hoggers the agitator may be supported by the central platform from which the rotating disc depends. Regardless of whether this is a rotating tub, or rotating platform, or stationary tub-type hogger. However, the option still exists to mount the agitator on the tub itself. In other types of hoggers, other mounting positions may be adopted.

The nature of the agitator may vary considerably. Ideally it is a dynamic moving piece of apparatus, rather than a stationary paddle or blade. In a preferred embodiment the main portion of the agitator may comprise a rotating beater or screw. In most cases the interacting portion of the agitator will comprise one or more blades. The action may typically be rotational, such as blades mounted on a rotating shaft. However, more complicated or other cyclical movements may also be employed. For instance a periodic reversible rotation similar to the central agitator action of most top loading washing machines may be employed. Various oscillating, up-and-down, vibrational etc type actions may be considered. However the extent and nature of movement should be such that the resulting agitation of the raw material by the agitator typically interferes with the normal motion of raw material within the apparatus, or is at least sufficient to present new or re-orientated material to at least the screen and/or the grinding apparatus—which in the case of the typical tub-type hogger being described, is a disc rotating relative to the tub itself.

Movement of the agitating means may also be further modified. The location of the agitator need not be stationary and it is possible that its position within the hogger varies. Similarly its approximate position may remain the same, but its orientation within hogging apparatus alters. Hence we have the possibility of quite complicated movement made up of smaller individual components affecting the overall agitating motion of the present invention.

Similarly also, certain motions of the agitator need not be continuous but may also be momentary, periodic, or according to various other timing schemes. It is possible also that agitation might only occur when certain circumstances arise, such as a certain type or level of raw material being present, or certain other conditions being sensed (or manually indicated by the operator).

For dynamic screening, the agitator is typically positioned, regardless of the type of hogger with which it is to be used, in such a manner that it is able to induce an agitating motion in the vicinity of, or adjacent, a screen. Additionally it is preferable that the agitator is positioned in the induced path of material for best effectiveness.

While in a preferred embodiment the shaft of the agitator is substantially horizontal to the bottom screen, vertically mounted agitators may be used also. Wider blades or paddles at the base of the shaft can be positioned close to the screen. Vertically oriented or vertically inclined agitators would also be useful for screens on the side of the tub.

Agitators may be mounted anywhere convenient. For instance they can be mounted at a suitable position on the bottom, side, or top of the hogger assembly as long as they extend to within the vicinity of a screen. An agitator may even be suspended and lowered into the drum at the desired position.

The construction of agitators may vary. Typically there is either some form of drive means, or means for transmitting power from a suitable motor source associated with the hogger apparatus. For instance, there may be a separate motor operating an agitator, or alternatively there may be a transmission or gear linkage to an existing motor driving other components of the hogger apparatus. In preferred arrangements, agitators comprise separate motors, preferably hydraulic, which directly drive the blades of the agitator. This can provide for some flexibility in the positioning and orientation of the agitators, with the main consideration being the routing of hydraulic (or other power) lines to the motor rather than transmission means to a remotely located motor.

Also provided on the agitating portion are blades about a body upon which they are mounted. As mentioned previously, specific designs can vary considerably and the agitator portion might comprise, for instance, a single flat blade, a screw, a twin open helical closed end configuration, and many other possible designs. User preference would play a large part in the adopted design, as well as efficiency and factors such as durability, design restraints within the apparatus, common materials being processed, and even the desired overall efficiency of the agitator—the efficiency of the agitator having some bearing on the average size of the reduced material which passes through a screen.

As previously mentioned, the preference is for a motor to directly drive the blades. Typically the motor will be connected to a shaft from which the blades depend. For closed type blade designs the shaft may extend substantially from the motor to the end of the blade positions. Various blade configurations, such as radially outward planar blades, helical screw blades about the shaft (either single or multiple threads), propeller type blades, as well as various other configurations and combinations may be adopted. The preference of the present invention, which depends of the type of hogger apparatus with which it is used, are for substantially radial and planar blades (e.g. for tub type apparatus), and helical blades (for inclined barrel apparatus)—seen more clearly in the ensuing drawings. However, different types of hoggers, and materials to be reduced, can lend themselves to different types of blade design.

For more open blade designs, the shaft may be restricted substantially to one end of the blade assembly. These open blade designs may have an open internal core, and may be more efficient for certain types of materials being reduced. However they may be susceptible to becoming off-balance if damage, of possibly weaker constructions, and being bound by would stringy materials if present. It is envisaged that optimum efficiencies relating to blade and agitator design may result from trial and experimentation on specific installations and setups, though would be well within the skill of a competent worker given the teachings and descriptions herein. Nevertheless, regardless of whether optimisation trials are performed, the present invention has the potential to improve efficiencies over unmodified hogger apparatus.

The rotational speed of the blades can have a bearing on efficiency. The optimum speed can vary according to the type of material being processed. Hence a preferred arrangement can include stepped or variable motor speed control to allow the motor (and hence blade) speed to be set to an appropriate level for the material being processed.

As a general guide for forestry wood based material with minimal green or leafy content, and being processed by a bottom screened vertical tub hogger, the following starting guidelines may be used. If one compares the tangential blade velocity of the tip of a blade at its point of closest approach to the screen, then this may be in the range of 1.0-2.0 m/s. However this is not meant to be limiting and different settings may be used in an optimised setup.

Where the bottom screen moves, then the aforesaid tangential blade velocity may be more closely matched to the linear velocity of the screen at the point of closest approach to the agitator. The screen linear velocity should be measured at a point halfway along the length of the agitator's blade portion. Here the blade tangential velocity should be within the inclusive range of 25-400% of the screen's linear velocity, though more preferably within 100±50%. Settings outside of these ranges are permissible, and may be used in varying setups and for different materials.

DETAILED DESCRIPTION OF THE PREFERRED EMBODIMENT

Figure 2:
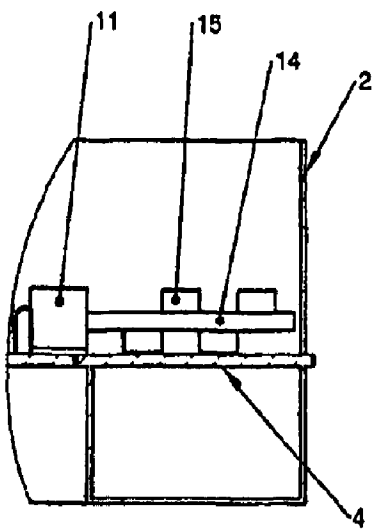
FIG. 2 is a side partial cross sectional view showing the preferred embodiment of the agitating means present in the apparatus of FIG. 1.
Figure 1:
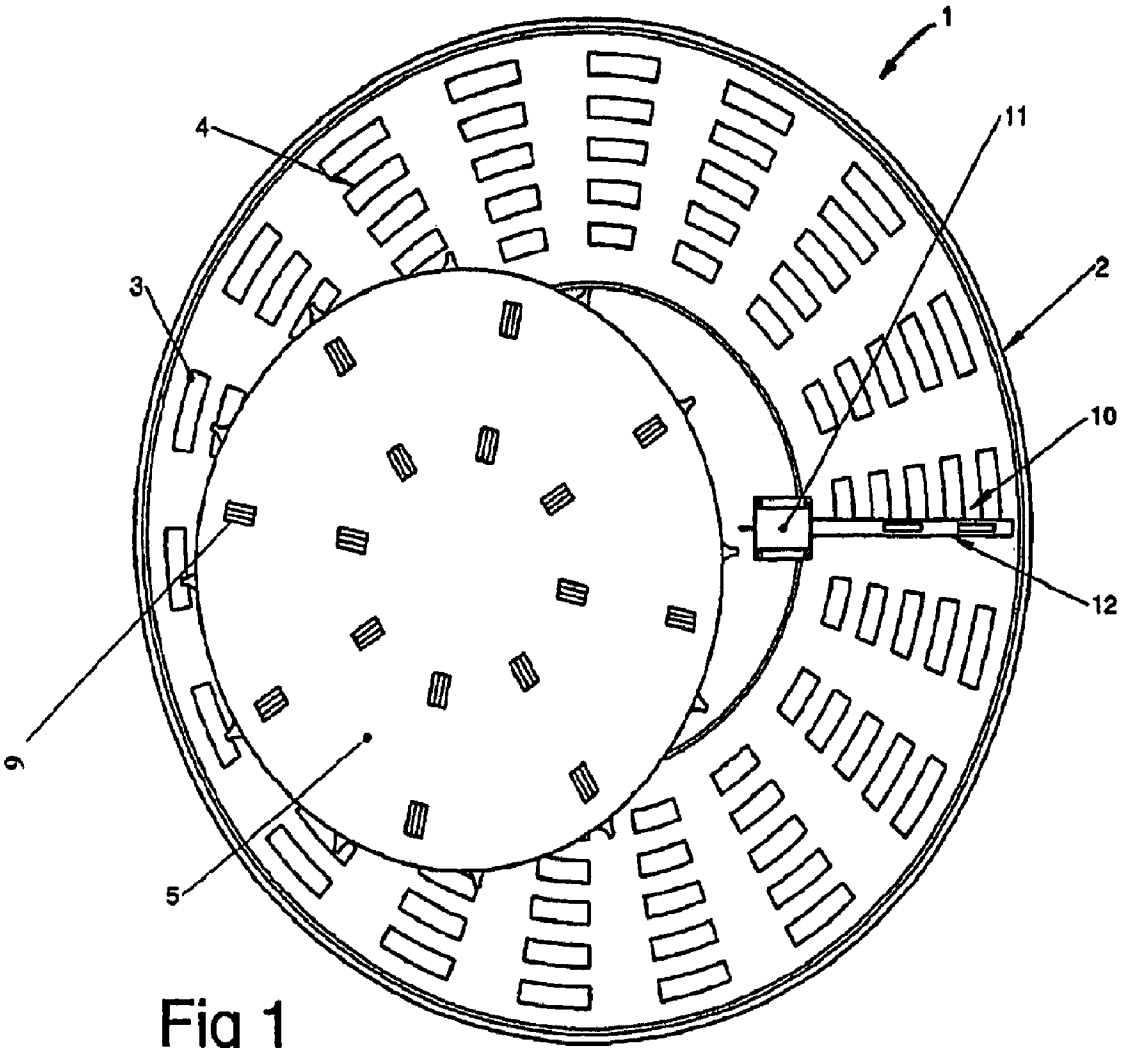
FIG. 1 is a top plan view of a tub-type hogger with a preferred embodiment of agitating means according to the present invention installed.

With reference to the drawings are by way of example only there is shown in FIG. 1 tub-type hogging apparatus comprising a tub generally indicated by arrow 1 with side walls (2) bottom (3) made up of at least partially of screens (4) with apertures. The rotating disc (5) has a plurality of teeth (6) which interacts with bulk material positioned within the tub (1). The disc (5) rotates about substantially a vertical axis, and is typically offset from the centre of the tub (1).

Also provided is agitating means generally indicated by arrow (10) consisting of a motor (11) and agitating portion (12). The agitating portion (12) comprises a shaft (14) with a plurality of substantially radially directed blades (15) extending therefrom. The motor is mounted on the central platform in which rotation relative to the tub (1) occurs (whether by tub or platform rotation).

The motor (11) is typically a hydraulic motor. Its rating will depend on the size of the hogger apparatus, materials being processed, and paddle size. Variable speed control is an option, providing some control over the degree of turbulence and agitation which is created. A typical motor for use in a tub type hogger may typically have an operating speed of around 150 rpm, and a power output of around 10 kW. Ideally the arrangement is such that the tangential speed of the blades at their closest approach to the screen is, when a rotating screen is present, within about 100±50% of the linear velocity of the screen at that point—as a preferred general guide. For stationary screens, the tangentially velocity of the blades at their outermost points may be about 1.0-2.0 m/s. However the characteristics of the material being processed can have a bearing on these figures, and variable speed control to allow an operator to set the motor speed for the type of material being reduced may be provided.

The agitating means (10) is positioned such that the agitating portion (12) is positioned over the screen portion (4). The rotating blades (15) tend to agitate bulk material in the vicinity of the screening portion (4), re-presenting it in new orientations, and assisting also to clear oversized material which may be blocking the apertures in the screen (4).

In a number of tub-type hogger designs, the drum (1) itself also rotates. In such a case it is desirable that the direction rotation of the agitator means is such that the blades (15) of the agitating means oppose the direction of travel of the tub (1). The speed of rotation should be such that the tangential linear velocity of the blades at their distance of closest approach to the bottom of the tub (1) (i.e. the screen (4)) is comparable to the linear velocity of the screen/bottom at this point. Variations from this comparative velocity may be employed in varying embodiments, though may accelerate wear of the blades (15), and promote energy wastage. It is envisaged that this is one parameter which may need to be adjusted for different installations so as to fine tune efficiency.

Figure 3:
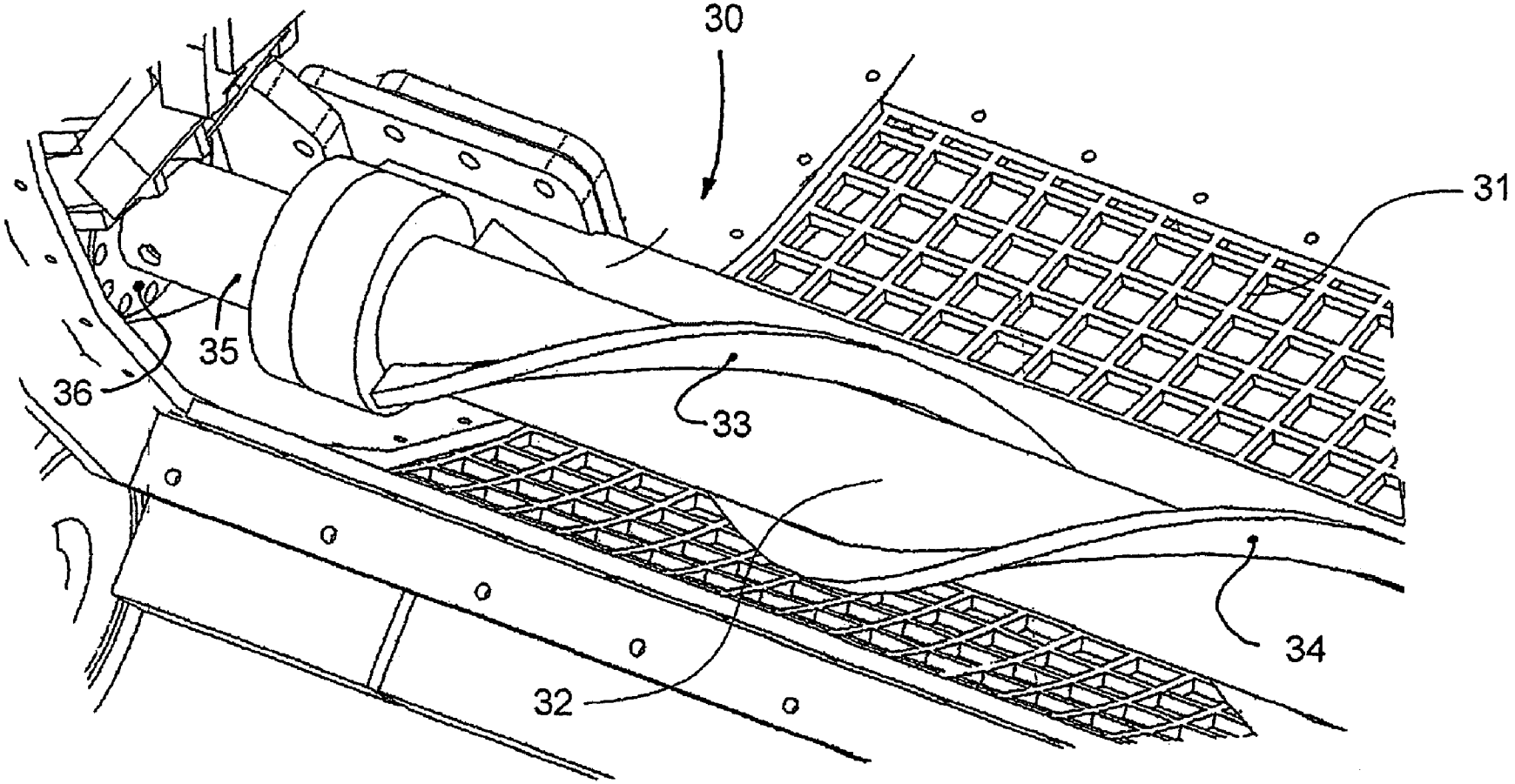
FIG. 3 is a perspective diagrammatic view of an alternative embodiment of agitating means according to the present invention.

FIG. 3 illustrates another embodiment of agitating means (generally indicated by arrow 30), used in combination with a curved screen (31). Here the agitating means comprises a central shaft (32) with twin helical blades (33, 34) spiralling thereabout. The shaft (32) is attached to a mount (35) comprising a shaft passing through a mount (36) leading to a pulley outside the apparatus. This pulley can then be driven by suitable motive means, though a motor may also be directly attached instead of the pulley arrangement.

Figure 4:
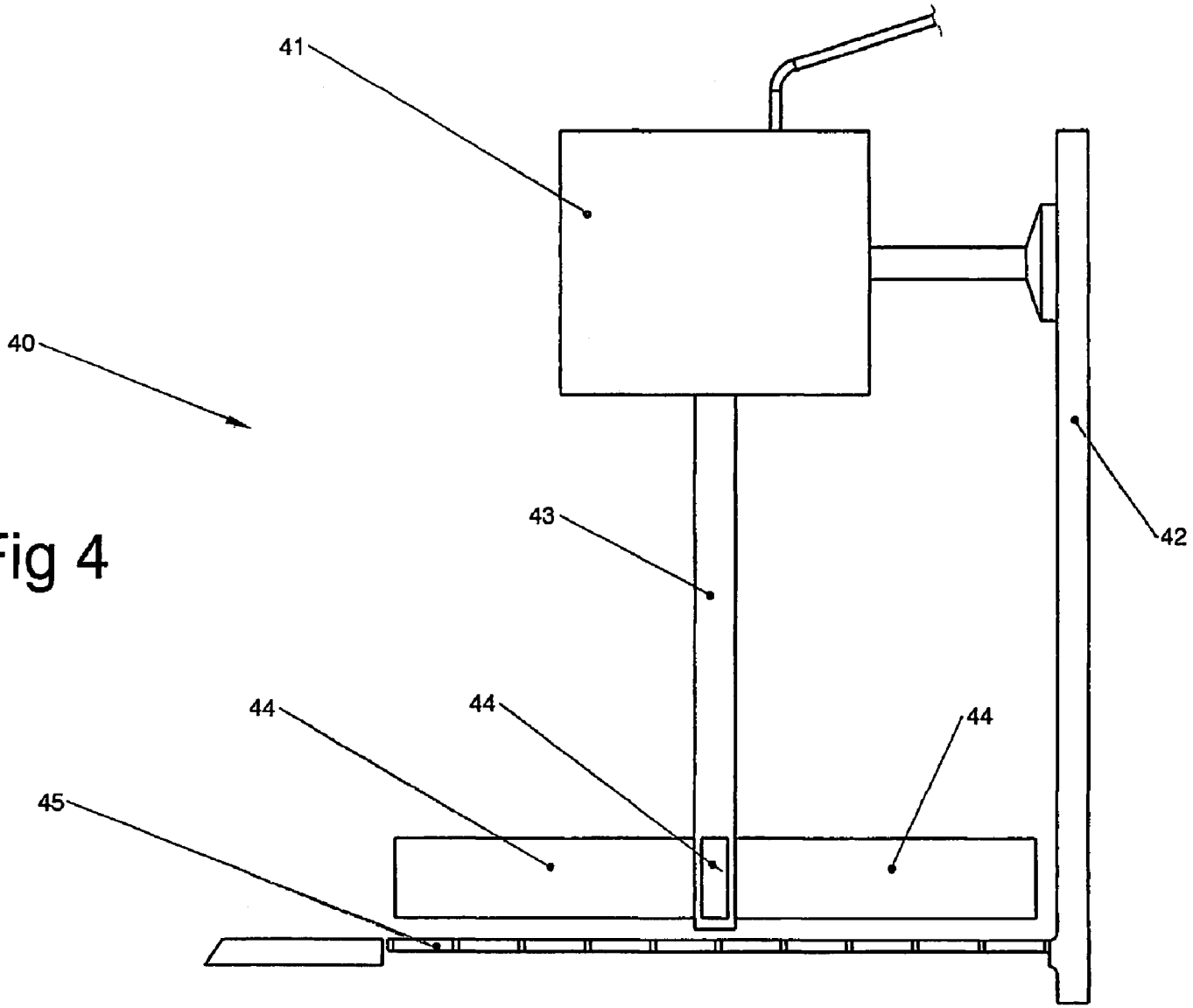
FIG. 4 is a side partial cross-sectional view of an alternative embodiment of the invention.

FIG. 4 illustrates an embodiment of a vertically oriented agitator (40), with motor (41) mounted to the side (42) of the tub. A shaft (43) extends to paddles (44) in the vicinity of bottom screen (45). The paddles (44) may be inclined with respect to the shaft (43) and may be propeller like in appearance or effect. In such a case ideally the propeller action will be such as to uplift material with which it interacts.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The claims defining the invention are:

1. An apparatus for comminuting raw material, comprising:

a housing including at least one screen for passing comminuted material up to a particular size;

a reducing assembly comprising a rotating toothed assembly; and at least one agitator in proximity to said screen which agitates material in its vicinity, wherein said agitator includes at least one rotating blade and in which said blade extends or depends from a rotating support driven by a motor, and the agitator is mounted such that a rotational axis of the support is substantially parallel to a general plane of said screen with which it interacts.

2. The apparatus as claimed in claim 1, wherein said screen is present in an end of said housing.

3. The apparatus as claimed in claim 1, wherein the housing rotates during operation of the apparatus.

4. The apparatus as claimed in claim 1, wherein said blade is substantially planar and a general plane of said blade is substantially perpendicular to the rotational axis of said support.

5. The apparatus as claimed in claim 1, wherein the blade of the agitator is substantially a propeller or turbine.

6. An apparatus for comminuting raw material, comprising:

a housing including at least one screen for passing comminuted material up to a particular size;

a reducing assembly comprising a rotating toothed assembly; and at least one agitator in proximity to said screen which agitates material in its vicinity, wherein said agitator includes at least one rotating blade and in which said blade extends or depends from a rotating support driven by a motor, and said blade of the agitator is helical and is substantially coaxial to the longitudinal axis of said support.

7. The apparatus as claimed in claim 1, wherein the housing is substantially cylindrical and is oriented such that its cylindrical axis is substantially vertical and the agitator interacts with a screen positioned at a bottom end of the housing;

the rotational axis of the rotating support being substantially parallel to the plane of the bottom end of the housing, and additionally orientated within ±45° inclusive of the perpendicular to the rotational axis of the housing.

8. The apparatus as claimed in claim 7, wherein the rotational axis of the rotating support is directed to trail tangentially outwardly from the general direction that the reducing assembly is rotating.

9. The apparatus as claimed in claim 1, wherein the agitator includes at least one moving blade or feature which interacts with raw material in a vicinity of the screen, said blade or feature approaching said screen by a distance of 250% or less of a diameter of an average diameter of a size of an article able to pass through the screen.

10. The apparatus as claimed in claim 1, wherein the agitator is powered by a hydraulic motor, electric motor, pneumatically powered motor, or fuelled motor which drives said rotating support.

11. The apparatus as claimed in claim 1, wherein there is variable or stepped speed control over the motor.

12. The apparatus as claimed in claim 1, wherein the motor is positioned remotely and drive transmitted to said rotating support.

13. The apparatus as claimed in claim 1, wherein the agitator includes a blade portion, and wherein the screen moves relative to said agitator, said blade portion rotating in a direction opposing the relative travel of the screen therepast.

14. The apparatus as claimed in claim 1, wherein the linear tangential speed of a blade at its position of closest approach to a screen, during normal operation, is within the inclusive range of 25% through 400% of a linear screen velocity of the screen relative to the blade at a point midway along a length of the blades about the rotating support.

15. The apparatus as claimed in claim 1, wherein there are a plurality of agitators.

16. The apparatus according to claim 1, wherein said blade of the agitator is helical and is substantially coaxial to the longitudinal axis of said support.

* * * * *